US005735097A

United States Patent [19]

Cheyne

[11] Patent Number: 5,735,097

[45] Date of Patent: Apr. 7, 1998

[54] PLATFORM ASSEMBLY SYSTEM

[76] Inventor: Donald C. Cheyne, 6410 W. Madison Rd., Alma, Mich. 48801-9511

[21] Appl. No.: 767,544

[22] Filed: Dec. 16, 1996

[51] Int. Cl.[6] ..... E04B 5/00; B63B 35/44

[52] U.S. Cl. ..... 52/489.1; 52/177; 52/489.2; 114/85; 114/264; 114/263

[58] Field of Search ..... 52/177, 489.1, 52/489.2, 741.4, 745.05, 747.1; 114/85, 263, 264

[56] References Cited

U.S. PATENT DOCUMENTS

| | | | |
|---|---|---|---|
| 3,046,852 | 7/1962 | Graham . | |
| 3,528,391 | 9/1970 | Johnson | 119/529 |
| 3,555,762 | 1/1971 | Costanzo, Jr. . | |
| 3,620,027 | 11/1971 | Nordell . | |
| 3,999,346 | 12/1976 | Fetherston . | |
| 4,078,515 | 3/1978 | Svirklys . | |
| 4,266,381 | 5/1981 | Deller . | |
| 4,907,387 | 3/1990 | Turnbull . | |
| 4,945,595 | 8/1990 | Meriweather . | |
| 4,947,595 | 8/1990 | Douds et al. . | |
| 5,009,045 | 4/1991 | Yoder . | |
| 5,048,448 | 9/1991 | Yoder | 52/588.1 X |
| 5,054,253 | 10/1991 | Bedics . | |
| 5,404,686 | 4/1995 | Esposito | 52/588.1 |
| 5,553,427 | 9/1996 | Andres | 52/177 |

OTHER PUBLICATIONS

Brock Manufacturing Brochure,Nov. 1994, pp. 6–7.

*Primary Examiner*—Robert Canfield
*Attorney, Agent, or Firm*—Knechtel, DeMeur & Samlan

[57] ABSTRACT

A plank assembly system having two elements: one being a plank member having a horizontal walking surface, two downwardly projecting vertical legs, each vertical leg having a barbed fastener, and a downwardly projecting center support. The second element of the device is a U-shaped retaining clip having a horizontal mounting surface which is affixed to a joist system, and two upwardly extending vertical legs, each upwardly extending vertical leg having an inwardly projecting barb sized to interlock with the barb on the downwardly projecting vertical leg of the plank member. The retaining clip is also made of extruded PVC and is cut to a width sufficient for proper installation and strength of the overall platform. A plurality of retaining clips are affixed to a joist system of either metal, plastic or wood using securing means such as screws, or nuts and bolts. The retaining clips are secured to the joist system end to end along their length in sufficient number to cover the joist system so that a platform of the desired size can be created. A bead of silicone caulk is placed between the plank member and retaining clip. The plank member is then placed over the retaining clip and locked into place.

1 Claim, 2 Drawing Sheets

PLATFORM ASSEMBLY SYSTEM

TECHNICAL FIELD

This invention relates generally to platforms used for docks, patios, decks, walkways, and the like, and more particularly to a platform assembly system.

BACKGROUND OF THE INVENTION AND PRIOR ART

Platform systems are routinely used as docks, patios, decks, walkways, and the like. Historically, platform systems have been made of wood or metal, most notably aluminum. More recently, plastic, typically in the form of poly vinyl chloride (PVC), has become the material of choice for many platform system applications. Plastic platform systems are an attractive alternative to wood or metal on many levels. Plastic is lighter than either wood or metal and, therefore, easier to handle and install. Plastic does not need varnishing, staining, or painting as does wood, and it can be exposed to a wide range of weather conditions, thereby creating a long lasting, low maintenance system. As a result of the above features and the additional feature that a plastic system can be less expensive to produce than either wood or metal systems, plastic platform systems are cost effective.

Over the years, attempts have been made to create a platform installation system which is easy to use and effective. The prior an is almost exclusively directed to metal platforms. Within the prior art are also found several devices which require the use of nuts and bolts for securing the plank members to one another. See for example, U.S. Pat. Nos. 5,412,915, 5,274,977, 4,947,595, and 4,266,381. Using such systems is time-consuming, and often requires special tools; therefore, these systems can be expensive.

Other attempts have been made to increase the simplicity of the installation process. One example is found in U.S. Pat. No. 3,999,346 which teaches an aluminum deck structure for use in platform tennis courts or other playing surfaces. This device consists of a decking surface having two vertical legs which terminate in essentially a T-shaped configuration. The device also has a lower portion consisting of an extruded aluminum joist having notches cut into it for receiving the vertical legs of the decking surface. A shortcoming of this device is that the lower section is expensive to manufacture since it requires a two step process in which the lower portion is extruded and the notches, via a second procedure, are cut with a press break. A further shortcoming of this device is that the lower joist section is extruded in long strips which must be cut to size in the field. Such cutting is time consuming and, if a measuring error is made, an entire joist section must be discarded.

Another example is seen in U.S. Pat. No. 5,048,448. In this system, a decking plank is secured to "snap locks" by means of an adhesive applied to the "snap lock", the plank then being affixed by rotating the plank into the "snap lock" receptacles, and a rubber mallet to set the center leg. A shortcoming of this device is that it is difficult to work with in close quarters since the planks must be rotated into place and set with a mallet. The rubber mallet not only increases the labor (and therefore, costs) involved in installing this system, but a mallet can also mar the decking surface and, if used incorrectly, crack the decking surface, center leg, and/or "snap lock". Thus, there is need for effective yet inexpensive and easy to use platform assembly system for polyvinyl chloride platforms.

OBJECTS OF THE INVENTION

It is an object of the present invention to provide a platform assembly system for polyvinyl chloride (PVC) platforms which is effective and easy to use when compared to existing construction techniques.

It is another object of the present invention to provide a platform assembly for PVC which requires no special tools and minimizes the risk of damage to the platform system during the installation process.

It is yet another object of the present invention to provide a platform assembly system for PVC which eliminates manufacturing and assembly steps as compared to present construction techniques.

It is yet a further object of the present invention to provide a platform assembly system for PVC which is cost effective.

SUMMARY OF THE INVENTION

The above objects are provided in a plank assembly system made of extruded PVC. The assembly system comprises two elements: one being a plank member having a horizontal walking surface, two downwardly projecting vertical legs, each vertical leg having a barbed fastener, and a downwardly projecting center support. The second element of the device is a U-shaped retaining clip having a horizontal mounting surface which is affixed to a joist system, and two upwardly extending vertical legs, each upwardly extending vertical leg having an inwardly projecting barb sized to interlock with the barb on the downwardly projecting vertical leg of the plank member. The retaining clip is also made of extruded PVC and is cut to a width sufficient for proper installation and strength of the overall platform.

According to the invention, a plurality of retaining clips are affixed to a joist system of either metal, plastic or wood using securing means such as screws, or nuts and bolts. The retaining clips are secured to the joist system end to end along their length in sufficient number to cover the joist system so that a platform of the desired size can be created. A bead of silicone caulk is placed between the plank member and retaining clip. The plank member is then placed over the retaining clip and locked into place.

BRIEF DESCRIPTION OF THE DRAWINGS

Features and details of the invention are described with greater specificity when referenced to the following drawings.

DESCRIPTION OF THE PREFERRED EMBODIMENT

Figure 1:
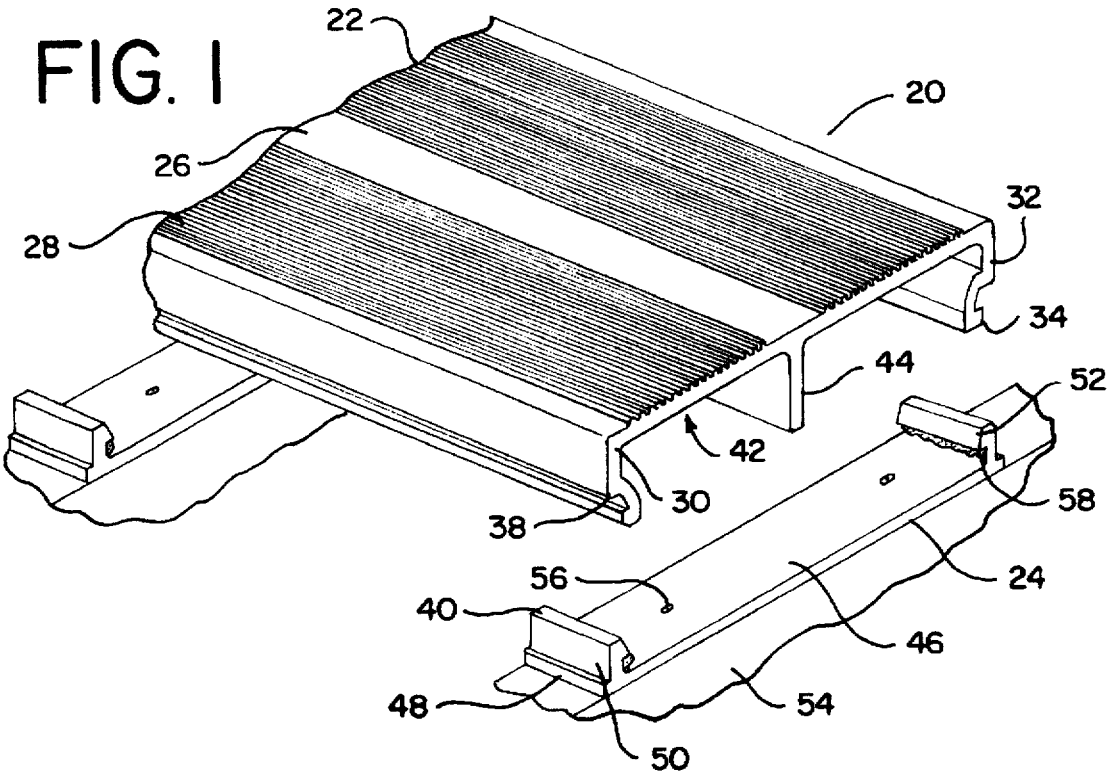
FIG. 1 is an exploded oblique top view depicting the plank member and receiving channels affixed to a joist system.

FIG. 1 depicts plank assembly 20 comprised of plank member 22 and retaining clip 24. Plank assembly 20 is made preferably of extruded polyvinyl chloride (PVC) with an ultra-violet light protection. Plank member 22 has a horizontal top surface 26 which serves as the walking surface for the completed platform. Horizontal top surface 26 has ribs 28 molded into it. Ribs 28 serve the dual function of increasing traction and insuring quick water run-off. Co-formed to the outer edges 30 of horizontal top surface 26 are downwardly projecting vertical legs 32. At the lower free ends of vertical legs 32 are found outwardly projecting barb fasteners 34.

Figure 2:
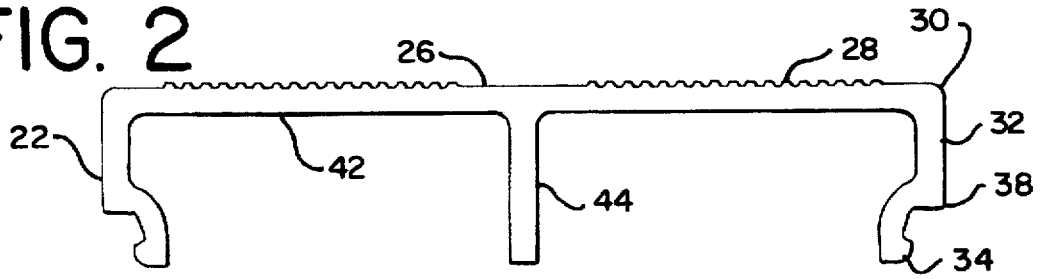
FIG. 2 is a side-plane view of the plank member.

Referring to FIG. 2, it can be seen that outwardly projecting barb fasteners 34 have an essentially "C" shape and are molded on to the inner wall 36 of downwardly projecting vertical leg 32. This molding configuration provides upper meshing surface 38 which will meet with lower meshing surface 40 (FIG. 3) of receiving channel 24, as more fully described below. Co-formed to bottom surface 42 of plank member 22 is center support 44. Center support 44 provides additional structural strength to plank member 22 and helps to decrease warping, thereby increasing the life of the plank assembly 20.

Figure 3:
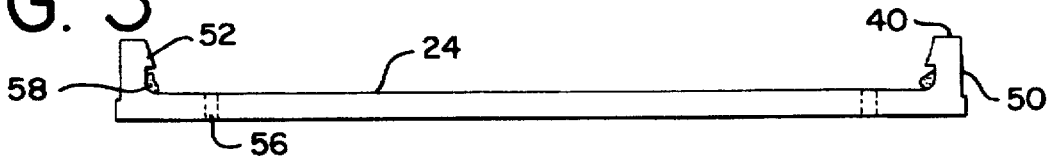
FIG. 3 is a side-plane view of the receiving channel with a bead of silicone caulk.

Retaining clip 24 is essentially "U" shaped. Retaining clip 24 has a horizontal length 46 which has as its outermost edges 48 upwardly projecting barb fasteners 50. At the top surface of upwardly projecting barb fasteners 50 is found upper meshing surface 40 (FIG. 3). The barbs 52 of receiving channel 24 are inwardly projecting and designed to interlock with the outwardly projecting barb fasteners 32 of plank member 22. While the preferred embodiment has the barbed fasteners 34, 50 at the outer edges of plank member 22 and retaining clip 24, it is also contemplated that they may be placed anywhere along the length of horizontal length 46 and top surface 26 which provides adequate strength and support.

When utilizing plank assembly 20, receiving channels 24 are fixed to joists 54 by means of receiving channel securing means 56. While FIG. 1 depicts screws as the securing means, other securing means, for example, nuts and bolts, can also be utilized. The securing means will be dictated by the size and material make up of joist 54. While joist 54 will typically consist of wood, metal or plastic can also be used. Receiving channels 24 are set and secured on joist 54 by abutting them against one another at outer edge 48 of horizontal length 46. Plank assembly 20 is designed to be applied to joist systems wherein joist 54 is 16 inches on center; however, the system can be used with the joist 54 being spaced as far apart as 24 inches on center.

After securing sufficient numbers of receiving channels 24 to joist 54, a bead of silicone caulk 58 is run along the bottom edge of barb 52 of receiving channel 24. Alternatively, the caulk may be run along the edge of barb fastener 34 of plank member 22. Silicone 58 serves a dual purpose: first, it provides separation between plank member 22 and receiving channel 24, thereby reducing the squeaking associated with PVC-to-PVC connections, and, second, once cured, it provides sufficient adhesion to prevent side-to-side movement of plank member 22 within receiving channel 24. The inventor has found that silicone caulk is superior to latex caulk, as latex will deteriorate quickly when exposed to the elements.

Figure 4:
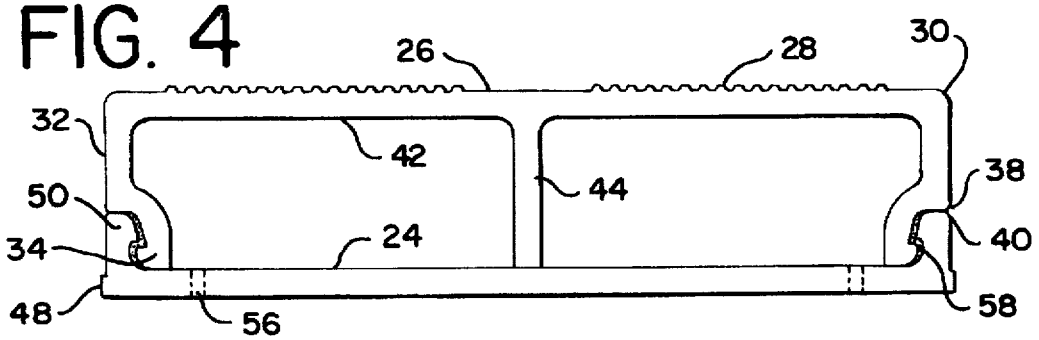
FIG. 4 is a side-plane view of plank member and receiving channel interlocked with one another.

Once the silicone 58 is in place, plank member 22 is fit over receiving channel 24 and, using downward pressure, snapped into place. Referring to FIG. 4, it can be seen that once snapped into place, the outwardly projecting barb fasteners 32 of plank member 22 fit snugly against the upwardly projecting barb fasteners 50 of receiving channel 24. The snugness of the fit causes the bead of silicone 58 to flatten out and create a film barrier between outwardly projecting barb fastener 32 and upwardly projecting barb fastener 50. Also, upper meshing surface 38 and lower meshing surface 40 come into contact with one another, thereby providing increased strength to the final plank assembly 20. The center support 44 then comes into contact with the upper surface 60 of receiving channel 24.

Figure 5:
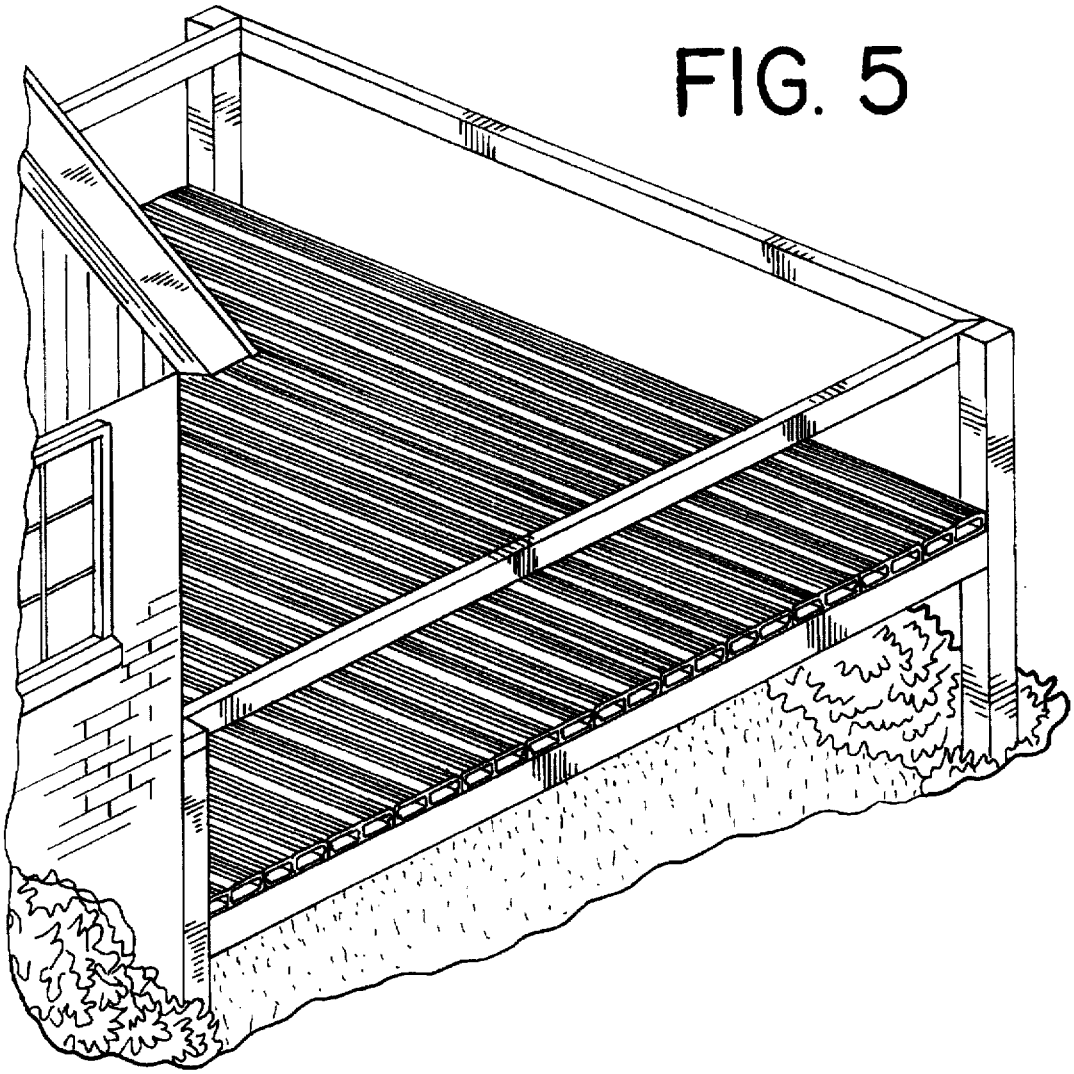
FIG. 5 is a representative embodiment of the device as used in a deck.
Figure 6:
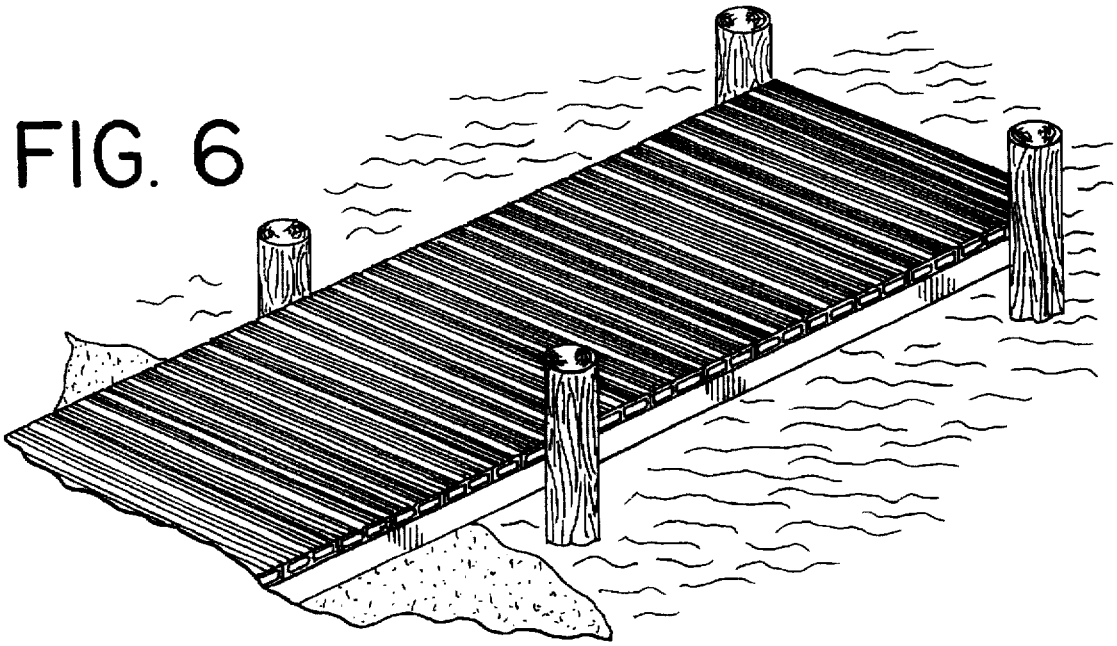
FIG. 6 is a representative view of the inventive device as used for a dock.

FIGS. 5 and 6 show non-limiting examples of the plank assembly 20 in use. FIG. 5 depicts the plank assembly 20 used as a deck, and FIG. 6 as a boat dock; however, these are non-limiting examples inasmuch as those skilled in the arts will readily see that the device has many uses, for instance, as a walkway, hot tub platform, patio and the like.

The above description of the preferred embodiment is for illustration purposes only and should be limited only by the appended claims.

I claim:

1. A platform assembly system to be secured to a substructure having joists comprising a plurality of plank members, each plank member having at least three downwardly projecting legs, with at least one of the downwardly projecting legs further comprising a vertical support member, the downwardly projecting legs further comprising two legs, each of which terminates in an offset barbed fastener;

a plurality of retaining clips, each retaining clip having upwardly projecting legs terminating in offset barb fasteners, which coincide with a downwardly projecting leg having an offset barb fastener;

whereby the plurality of retaining clips are adapted to be secured to the substructure in a number sufficient to create support for the desired finalized platform assembly, and the plank members are adapted to be secured to the retaining clips by interlocking the offset barbed fasteners of the downwardly projecting legs into the upwardly projecting offset barb fasteners of the retaining clips such that the downwardly projecting legs of the plank members align vertically above the upwardly projecting legs of the retaining clips.

* * * * *